US010064483B2

(12) United States Patent
Mitchell

(10) Patent No.: US 10,064,483 B2
(45) Date of Patent: Sep. 4, 2018

(54) WRIST AND FOREARM SUPPORT DEVICE

(71) Applicant: Dennis Alan Mitchell, Huntington, NY (US)

(72) Inventor: Dennis Alan Mitchell, Huntington, NY (US)

( * ) Notice: Subject to any disclaimer, the term of this patent is extended or adjusted under 35 U.S.C. 154(b) by 0 days.

(21) Appl. No.: 15/354,550

(22) Filed: Nov. 17, 2016

(65) Prior Publication Data

US 2017/0065075 A1 Mar. 9, 2017

Related U.S. Application Data

(63) Continuation-in-part of application No. 14/850,231, filed on Sep. 10, 2015, now abandoned.

(60) Provisional application No. 62/048,483, filed on Sep. 10, 2014.

(51) Int. Cl.
*B68G 5/00* (2006.01)
*A47B 21/03* (2006.01)

(52) U.S. Cl.
CPC ..... *A47B 21/0371* (2013.01)

(58) Field of Classification Search
CPC .. A47B 21/0371; G06F 3/039; A61F 5/05841
See application file for complete search history.

(56) References Cited

U.S. PATENT DOCUMENTS 443,839 A * 12/1890 Steinhauer ..... A47B 21/0371 248/118
612,172 A * 11/1898 McKelvey ..... A47B 21/0371 248/118
915,047 A * 3/1909 Smith ..... A47B 21/0371 248/118
5,398,896 A * 3/1995 Terbrack ..... A47B 21/0371 248/118
5,762,302 A * 6/1998 Myers ..... A47B 21/0371 248/118.5
6,454,224 B1 * 9/2002 Nogueira ..... A47B 21/0371 248/118
9,360,951 B2 * 6/2016 Moy ..... G06F 3/039
9,593,713 B2 * 3/2017 Farahati ..... F16C 17/04
9,829,147 B2 * 11/2017 Baker ..... A45D 29/00

* cited by examiner

*Primary Examiner* — Amy J. Sterling

(57) ABSTRACT

A support device adapted for improving the ergonomic support for the arm and wrist and forearm of a user of computer-related input devices is provided. The support device may include a body interconnecting a base to two spaced apart wing supports oriented at latitudinal and longitudinal support angles relative to the supporting surface on which the devices slides. Each wing provides waterfall edges along its periphery. The void between the wing supports, the supine triangular shape, and the waterfall edges facilitates a more neutral position of the forearm and wrist supporting between the two wing supports, reducing pressure points there along, and avoiding direct pressure to the carpal tunnel canal and mid-forearm regions that house anatomical structures that may be impacted by high pressures. The latitudinal support angle can be adjusted.

15 Claims, 9 Drawing Sheets

Foam wrist rest (no void or channel) illustrating high pressure at center of wrist – forearm Pressure distribution with winged open channel (void) wrist/forearm support

WRIST AND FOREARM SUPPORT DEVICE

CROSS-REFERENCE TO RELATED APPLICATION

This application is a continuation in part of U.S. non-provisional application Ser. No. 14/850,231, filed Sep. 10, 2015 which claims the benefit of priority of U.S. provisional application Ser. No. 62/048,483, filed Sep. 10, 2014, the contents of which are herein incorporated by reference.

BACKGROUND OF THE INVENTION

The present invention relates to computer accessories and, more particularly, to a device adapted for improving the ergonomic support for the arm and wrist and forearm of a user of computer keyboards, computer mouse devices and other computer-related input devices.

The devices currently employed to support the arms and hands of users of computer-related input devices have one or more of the following ergonomic flaws: 1) such supporting devices support the user's wrist and forearm too low relative to the input device whereby the resulting wrist and forearm posture over extends the users' wrist and forearms while typing or "mousing"; 2) such supporting devices apply direct pressure on the carpal tunnel canal and middle of the wrist and forearm of the user; 3) such supporting devices are not adapted to continuously maintain support for the weight of the user's arm when they transition between two input devices—i.e., the arm goes unsupported when the user transitions between the mouse and the keyboard; and 4) such supporting devices are integrated to either the computer mouse device or the computer keyboard, and so preclude the use of a preferred input device or the transition between them.

In other words, current wrist and forearm rests are too low, forcing the wrist and forearm to assume an awkward "non-neutral" posture on the device, while the carpal tunnel canal region and mid-forearm directly bears on said current wrist and forearm rests, thereby compounding overall arm discomfort and stress on the finger tendons disposed within the middle of the forearm. Also, the current static wrist and forearm rests do not support the weight of the arm while transitioning from keyboard to mouse device, and vice versa, which tends to transfers stress to the user's shoulders.

As can be seen, there is a device adapted for improving the ergonomic support for the arm and wrist and forearm of a user of computer keyboards, computer mouse devices and other computer-related input devices.

SUMMARY OF THE INVENTION

In one aspect of the present invention, a wrist and forearm support device for supporting a wrist and forearm during the use of computer-related input devices resting on a supporting surface includes a body extending from a base end to a wing end; two wing support spaced apart by a predetermined void along the wing end; each wing support extending from a distal end to a narrower proximal end so as to define a supine triangle shape, wherein each wing support is oriented at a longitudinal and a latitudinal support angle relative to the supporting surface; and a base having a bottom surface for engaging the supporting surface, wherein an opposing top surface of the base is rotatably connected to the base end.

In another aspect of the present invention, a wrist and forearm support device for supporting a wrist and forearm during the use of computer-related input devices resting on a supporting surface includes a body extending from a base end to a wing end; two wing support spaced apart by a predetermined void along the wing end, wherein the predetermined void is dimensioned and adapted to accommodate a carpal tunnel region of a human user's forearm so as not to apply pressure thereto, and wherein a periphery of each wing support provides a waterfall edge; each wing support extending from a distal end to a narrower proximal end so as to define a supine triangle shape, wherein each wing support is oriented at a longitudinal and a latitudinal support angle relative to the supporting surface, wherein the latitudinal support angle ranges between seven and fourteen degrees, and wherein the longitudinal support angle ranges between five and twenty degrees; and a base having a bottom surface for engaging the supporting surface, wherein an opposing top surface of the base is rotatably connected to the base end, wherein the bottom surface provides a low friction element, and wherein the top surface provides a slanted surface to which the base end is rotatably engaged so that the latitudinal support angle is adjustable between a minimum and a maximum angle of incidence upon rotating the base relative to the body 180 degrees.

These and other features, aspects and advantages of the present invention will become better understood with reference to the following drawings, description and claims.

DETAILED DESCRIPTION OF THE INVENTION

Figure 1:
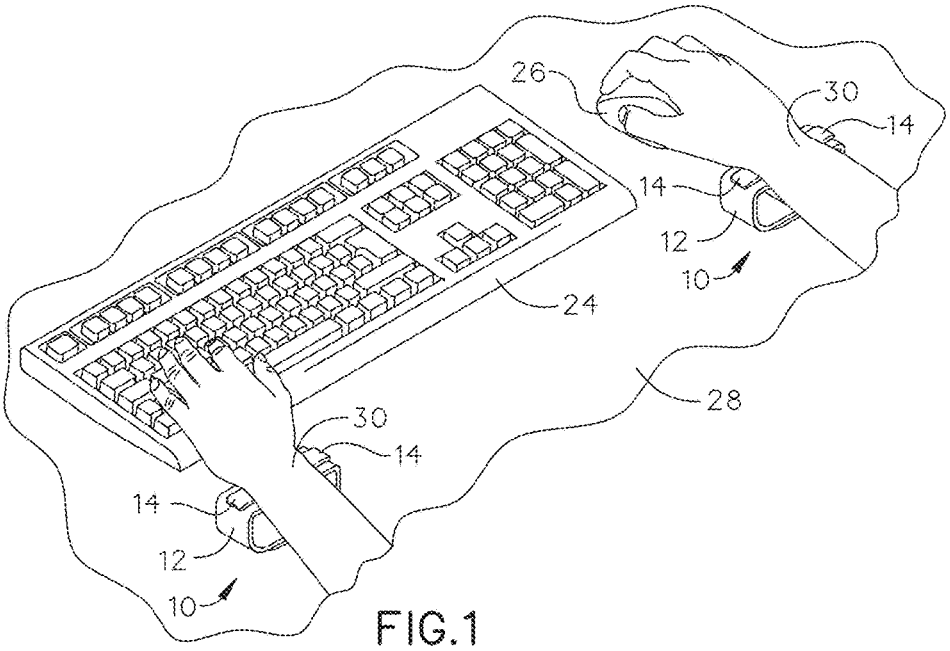
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the present invention.

Broadly, an embodiment of the present invention provides a support device adapted for improving the ergonomic support for the arm and wrist and forearm of a user of computer-related input devices. The support device may include a body dimensioned and adapted for maintaining two support pads spaced apart along a shared horizontal axis so as to form a predetermined void along said horizontal axis and at a predetermined vertical distance above a supporting surface. The predetermined void prevents direct pressure to a carpal tunnel canal region of a supported wrist and forearm. The support device provides a low-friction base for sliding along the supporting surface for maintaining wrist and forearm support as the user transitions between input devices.

Referring now to FIGS. 1 through 6, the present invention may provide a support device 10 adapted for improving the ergonomic support for the arm and wrist and forearm 30 of a user of computer keyboards 24, computer mouse devices 26 and other computer-related input devices.

Figure 4:
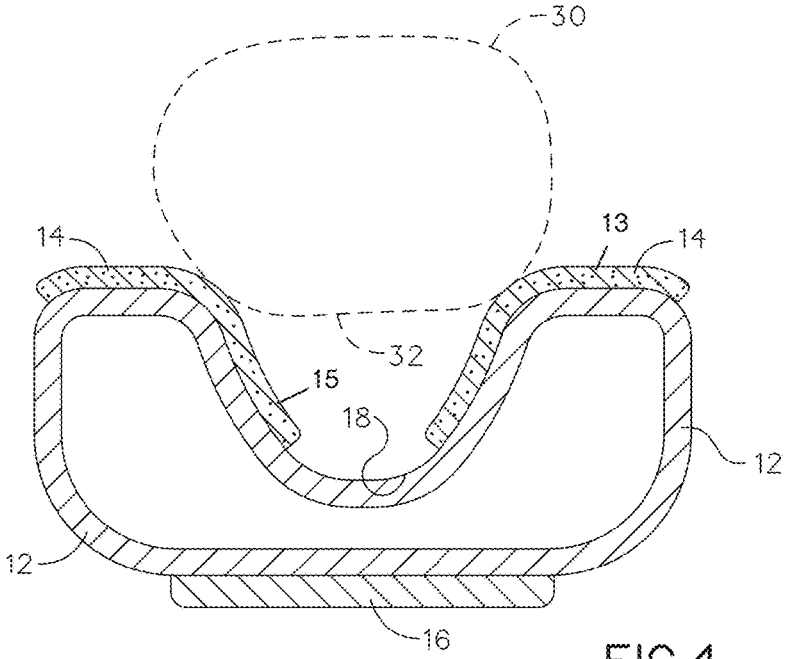
FIG. 4 is a section view of an exemplary embodiment of the present invention, taken along line 4-4 in FIG. 2.

The support device 10 may include a body 12 dimensioned and adapted for supporting two, spaced-apart support pads 14. Each support pad 14 may be disposed an approximately equal vertical distance above a supporting surface 28. In certain embodiments, the predetermined vertical distance may range from approximately 0.75 inches to approximately 3 inches. It being understood that terms 'vertical,' 'above,' 'horizontal,' 'upper,' 'lower' and 'downwardly' are defined relative to the direction of gravity, from 'above' and directed 'Vertically' 'down' toward the presumed flat, horizontal supporting surface 28. In other words, a vertical distance between the supporting surface 28 and each support pad 14 is approximately equal. Each support pad 14 is spaced apart a 'horizontal' distance so as to form a predetermined void dimensioned and adapted to accommodate a carpal tunnel canal region 32 of the user's wrist and forearm 30, as illustrated in FIG. 4.

The two support pads 14 may be dimensioned and adapted so that a human user's wrist and forearm maintains a generally neutral wrist and forearm posture while using the supporting device 10, thereby lessen musculoskeletal stress. In certain embodiments, each support pad 14 includes a generally horizontal portion 13 joined to an angled portion 15, wherein the angled portion 15 slopes downwardly toward its opposing angled portion 15 at a predetermined angle. The predetermined angle may be adapted to maintain the neutral wrist and forearm posture while supporting the wrist and forearm 30 without directly pressuring the carpal tunnel canal region 32, whereby supporting pressure is maintained near and along the sides of the user's wrist and forearm 30, as illustrated in FIGS. 1 and 4. In certain embodiments, the predetermined angle may range from approximately five degrees to approximately 50 degrees, relative to the joined horizontal portion.

Figure 2:
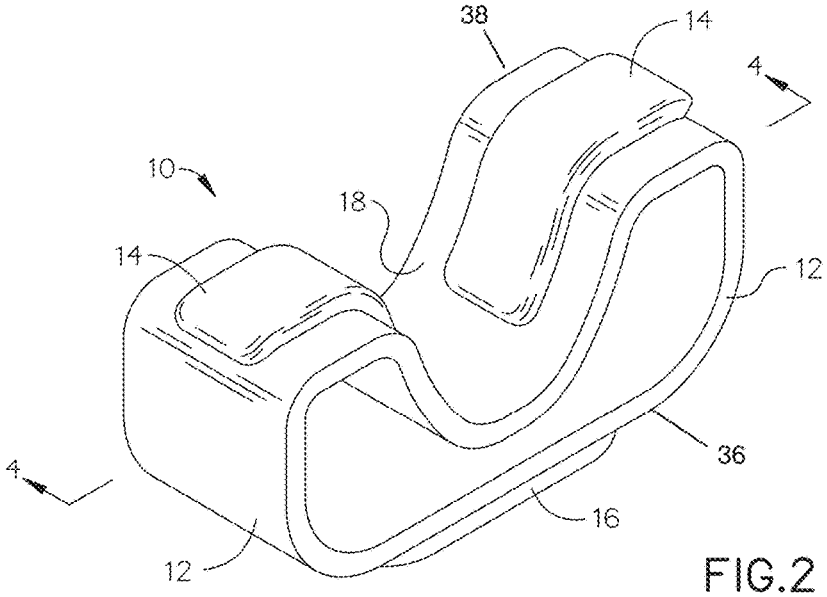
FIG. 2 is a top perspective view of an exemplary embodiment of the present invention.
Figure 3:
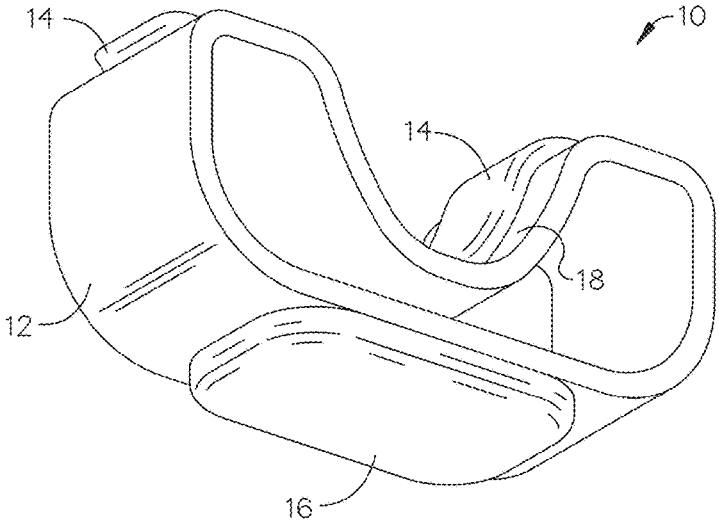
FIG. 3 is a bottom perspective view of an exemplary embodiment of the present invention.
Figure 5:
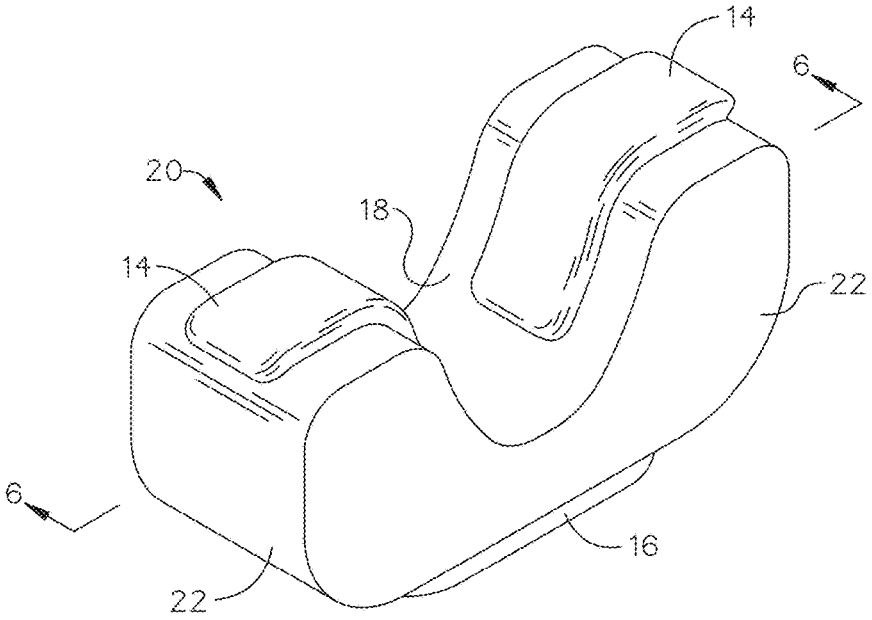
FIG. 5 is a perspective view of an exemplary embodiment of the present invention.
Figure 6:
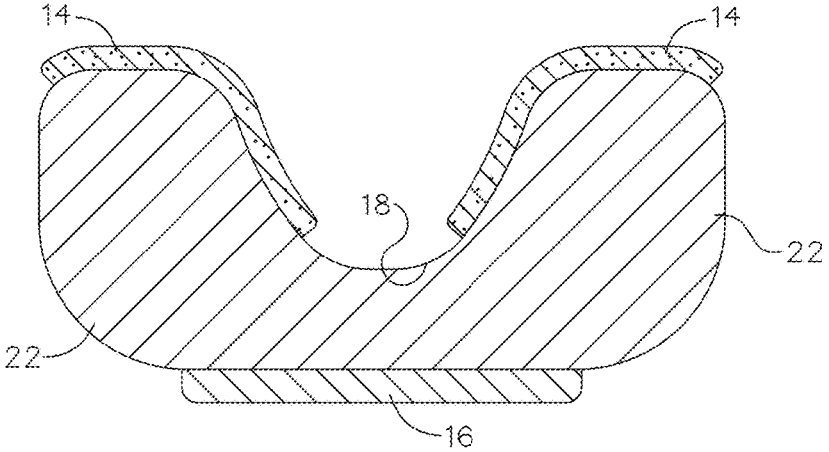
FIG. 6 is a section view of an exemplary embodiment of the present invention, taken along line 6-6 in FIG. 5.

In certain embodiments, the body 12 may form a generally V-shaped channel 18 so that two support pads 14 are spaced apart a shared horizontal plane/axis so as to form the predetermined void disclosed above, and illustrated in FIG. 2. In certain embodiments, the body 12 may be hollow, as illustrated in FIGS. 2-4, while in alternative embodiments, the body 12 may be a solid body 22, as illustrated in FIGS. 5-6. The body 12 may include a lower portion 36 and an upper portion 38. The support pads 14 may be disposed on the upper portion 38. A base 16 may be disposed on the lower portion 36.

The base 16 may be a low-friction component, such as but not limited to, a low friction material, rotating wheels or the like. As a result, the base may be adapted to glide/slide the body 12 along the supporting surface 28. In certain embodiments, the supporting surface 28 is shared by the computer keyboard 24, tablet and/or the computer mouse device 26 so that the user's wrist and forearm 30 is supported while keying, mousing and/or transitioning in between input devices, thereby reducing musculoskeletal stress to the user's upper arm, neck and shoulder. In alternative embodiments, the supporting device 10 may be used for other types of manually operated controls and input devices having a supporting surface 28 nearby. As way of example, the supporting device 10 may be used by a light rail operator maintaining the control throttle.

A method of using the present invention may include the following. The supporting device 10 has described above may be provided. The user rests their wrist and forearm 30 between the two supporting pads 14 in a comfortable, neutral posture for keying, mousing, or transitioning between the input devices, whereby the user may apply pressure so that the low friction base 16 slides along the supporting surface 28. To disengage from the present invention, the user simply raises their wrist and forearms 30 from the supporting pads 14.

Referring to FIGS. 7-15, another embodiment of the support device 10 may include two wing supports 50, a body 60 and a base 40. The body 60 may be any shape that extends from a base end 62 to a wing end 64. The base end 62 may be rotatably connected to a slanted surface 44 of the base 40 about a first axis 80. The two wing supports 50 may be spaced apart and connected along the wing end 64 of the body 64.

Figure 11:
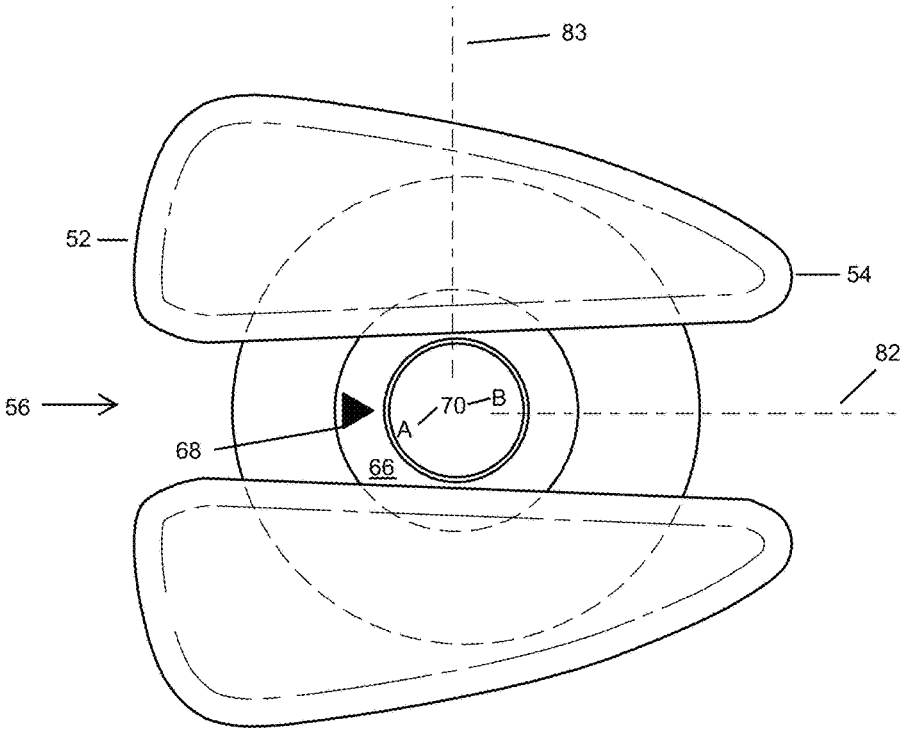
FIG. 11 is a top plan view of an exemplary embodiment of the present invention.
Figure 12:
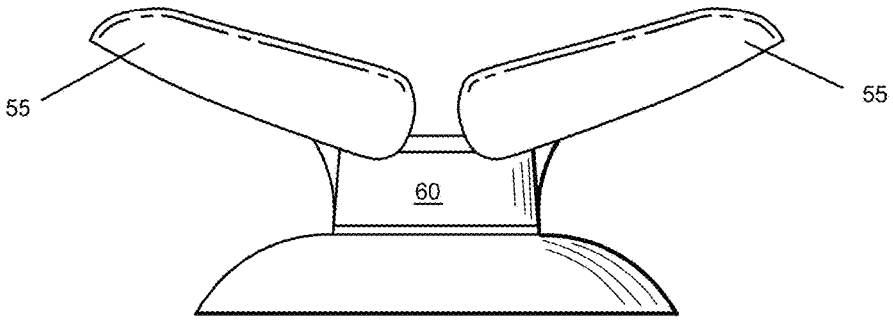
FIG. 12 is a rear view of an exemplary embodiment of the present invention.

The two wing supports 50 may be soft material or pads that extend from the wing end 64 at a longitudinally support angle relative to a second axis 82, which is enumerated in FIG. 11. In certain embodiments, the longitudinal support angle may be between 5 to 25 degrees relative to the second axis 82.

Figure 7:
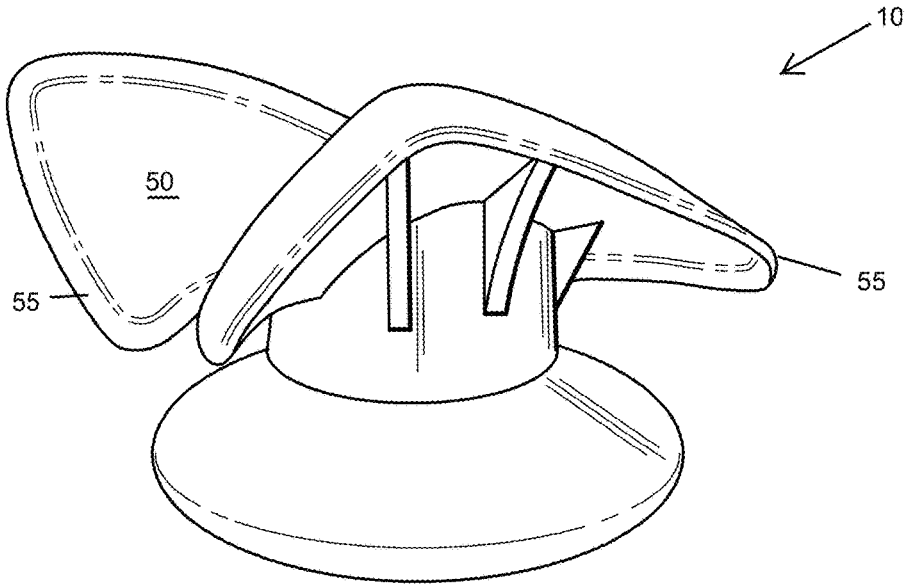
FIG. 7 is a top perspective view of an exemplary embodiment of the present invention.
Figure 8:
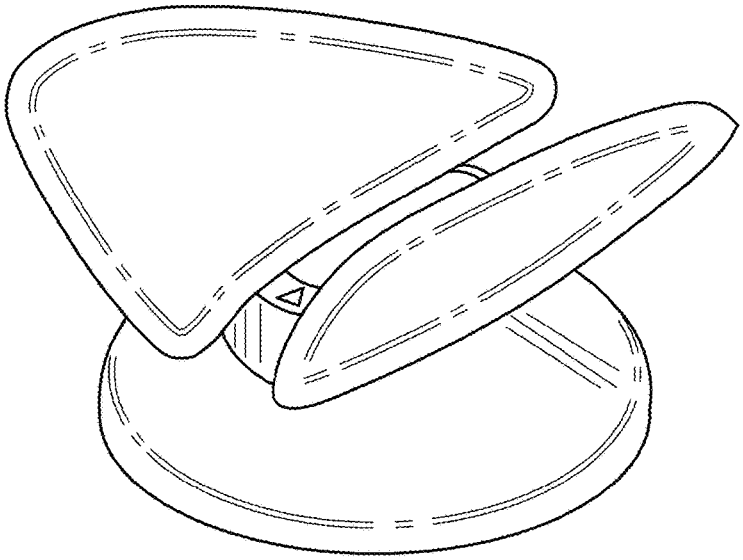
FIG. 8 is a top perspective view of an exemplary embodiment of the present invention.
Figure 9:
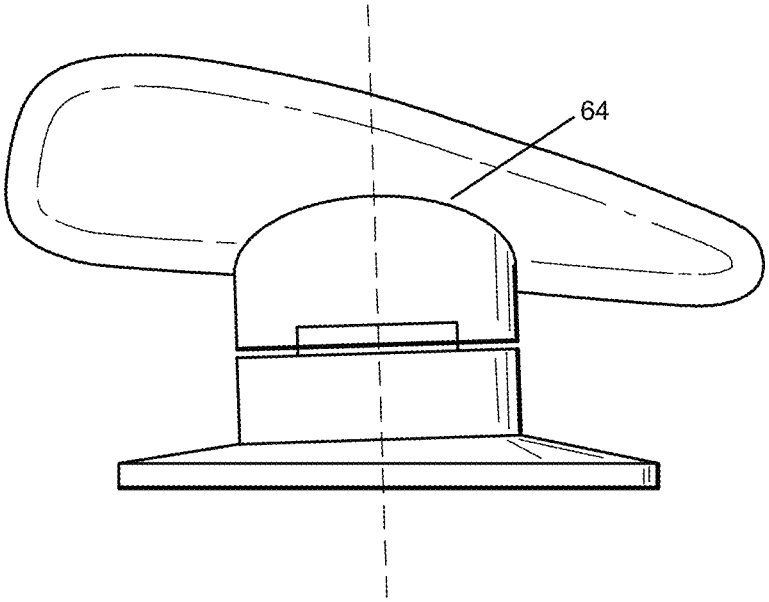
FIG. 9 is an elevation view of an exemplary embodiment of the present invention.
Figure 10:
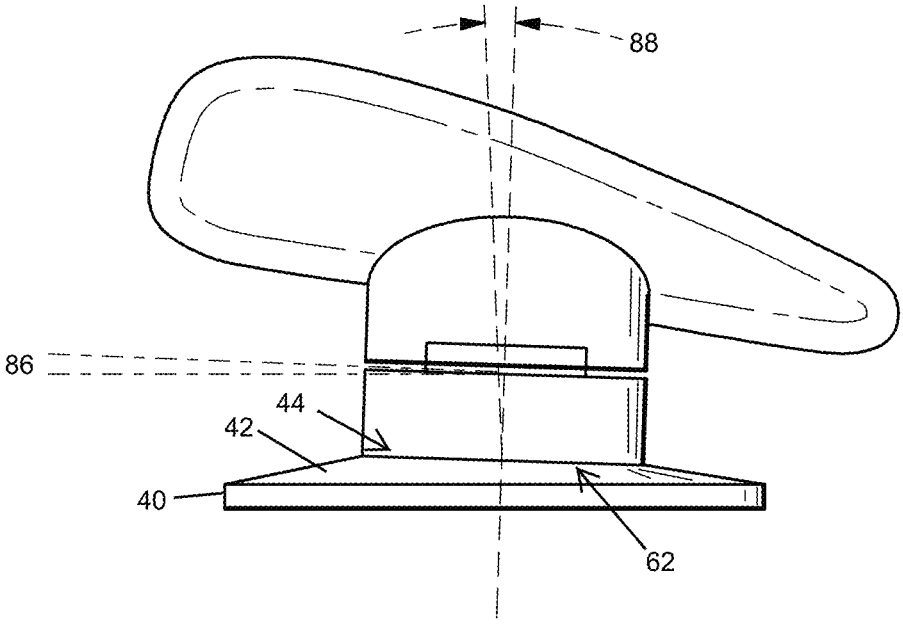
FIG. 10 is an elevation view of an exemplary embodiment of the present invention, demonstrating adjusting a latitudinal support angle of the wing supports by rotating a body relative to a wedged-shaped slanted surface of the base.

A void 56 may be provided between the spaced apart wing supports 50 so that a gauge portion 66 of the wing end 64 is visible, as illustrated in FIGS. 8 and 10. The void 56 may be between a half inch and an inch and a quarter or other suitable distance to accommodate the volume of the forearm of the user therein. Each wing support 50 may have a supine triangular shape that extends from a wider distal end 52 to a narrower proximal end 54, as illustrated in the Figures. A user may rest their wrist just beyond the distal end 52 as their forearm is supported between the distal end 52 and proximal end 54. The two wing supports 50 may also provide a latitudinal support angle relative to a third axis 83. In certain embodiments, the latitudinal support angle is seven and fourteen degrees so that the distal end 52 is a greater distance above the supporting surface 28 compared to the proximal end 54, as illustrated in FIG. 7. Between seven and fourteen degrees being the natural slant of a human user's forearm.

Each wing support 55 provides waterfall edges 55 along their periphery, wherein the waterfall edges 55 are dimensioned and adapted to contact with the user's forearm to reduce or minimize high concentrations of pressure. The waterfall edges 55 may have a radius of curvature of approximately a quarter inch. The supine triangular design for the user to be able to modify forearm placement, from the wrist crease (distally) to close to the elbow (proximally) without any area where there is not a waterfall edge 55.

Other designs have abrupt sharp or small radial surface edges which creates shear which can lead to discomfort and other medical medleys.

The latitudinal and longitudinal support angles of the wing supports 50 allows for the support of the natural angles of the base of the forearm while the top of the arm remains flat, thereby invoking a more neutral position of the forearm and wrist. The flatter winged shape also allows any portion of the forearm from wrist to elbow to be placed in the rest without having to adjust the separation of the pads (void 56). The waterfall front, rear and side of the pads/wing supports 50 reduce pressure points on the forearm or wrist of the user.

The base 40 may have a bottom surface for engaging the supporting surface 28, such as a desktop, table of the like. The bottom surface may provide a low-friction component, such as but not limited to, a low friction material, rotating wheels or the like. As a result, the base 40 may be adapted to glide/slide along the supporting surface 28. Opposing the bottom surface, the base 40 provides a top surface 42, and along at least a portion of the top surface 42 is the slanted surface 44, or wedged shape. A distance between the (flat) supporting surface 28 and the slanted surface 44 increases or decreases when moving along the second axis 82.

The base end 62 of the body 60 is generally orthogonal relative to the body 60, and so when the base end 62 and the slanted surface 44 interface as the body 60 rotates about the first axis 80 an angle of difference 88 is defined relative to the first axis 80, as illustrated in FIG. 10. As a result, a complementary angle of incidence 86 is defined relative to the second axis 82, thereby allowing a user to change the latitudinal support angle between a minimum and maximum by rotating the body 60/two wing supports 50 relative to the base 40. In other words, a predetermined point along the orthogonal base end 62 selectively rides the wedge shape of the slanted surface 44 as the two surface rotate relative to each other 180 degrees between minimum and maximum angles of incidences 86. As a user rotates, they can gauge the change of latitudinal support angle by viewing the gauge portion 66, which may provide an indicator 68 that would align with or be adjacent to an angle indicia 70 (also provided along the visible gauge portion 66) representing the minimum ('A') and maximum ('B') angle of incidence 86, as illustrated in FIG. 11. The difference between the latitudinal support angle—i.e., the difference between the minimum and maximum angle of incidence 86—can be between five and twenty-five degrees in different embodiments.

The design of the present invention is adapted to accommodate a large variation in what part of the forearm can be placed in the support device 10 while supporting the upper extremity also allows for different size users from small women to large males to use the support device 10 without adjustment to accommodate forearm volume, breadth and depth and length. The adjustability allows users to modify the effective fingertip height to accommodate very thin or very thick input devices, such as tablets, keyboards, laptops or other work surfaces.

Utilizing the angle of incidence 86 of the forearm support to modify the latitudinal support angle and thus the inclination between the hand height and the forearm height, results in a smaller change to the center of mass of the upper arm as there is no change in upper arm angle if the forearm angle is changed. As opposed to other devices that simply raise and lower a user's whole upper and lower arm, whereby if the height of such devices is raised, the resulting increase in the upper arm (shoulder) angle and also the center of mass of the arm thereby increases torque on the shoulder compared to that of simply changing the angle of incidence 86 of the forearm. In other words, if one were to simple raise the height of the support then the upper arm angle would be increased thereby increasing the moment at the shoulder, by changing just the angle of the forearm only the forearm and elbow angles are affected.

Figure 13:
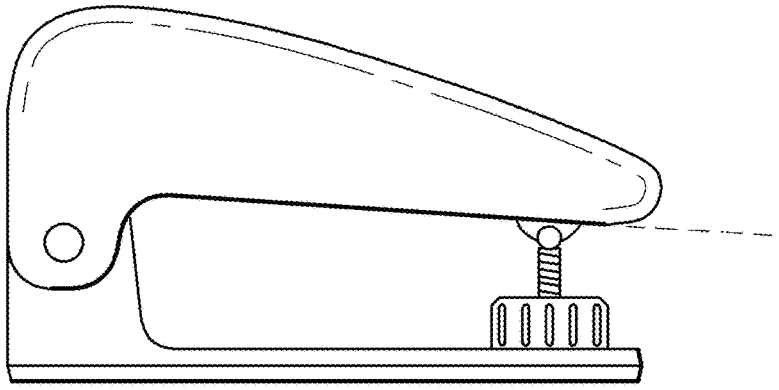
FIG. 13 is a side elevation view of an exemplary embodiment of the present invention.
Figure 14:
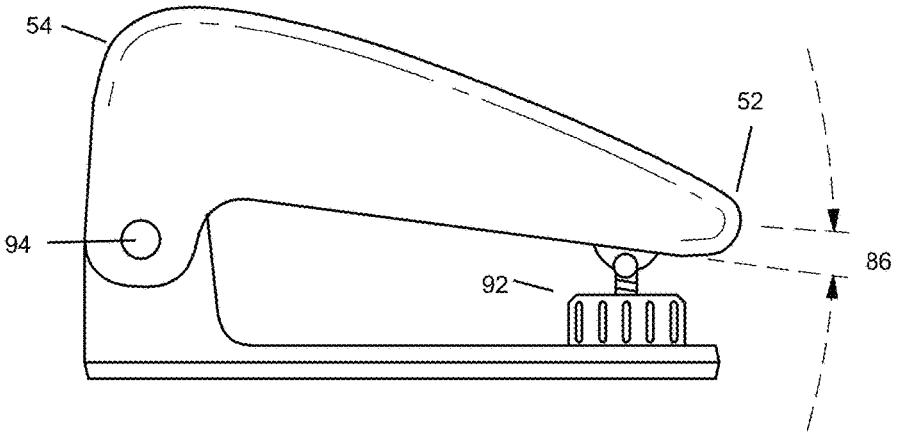
FIG. 14 is a side elevation view of an exemplary embodiment of the present invention.
Figure 15:
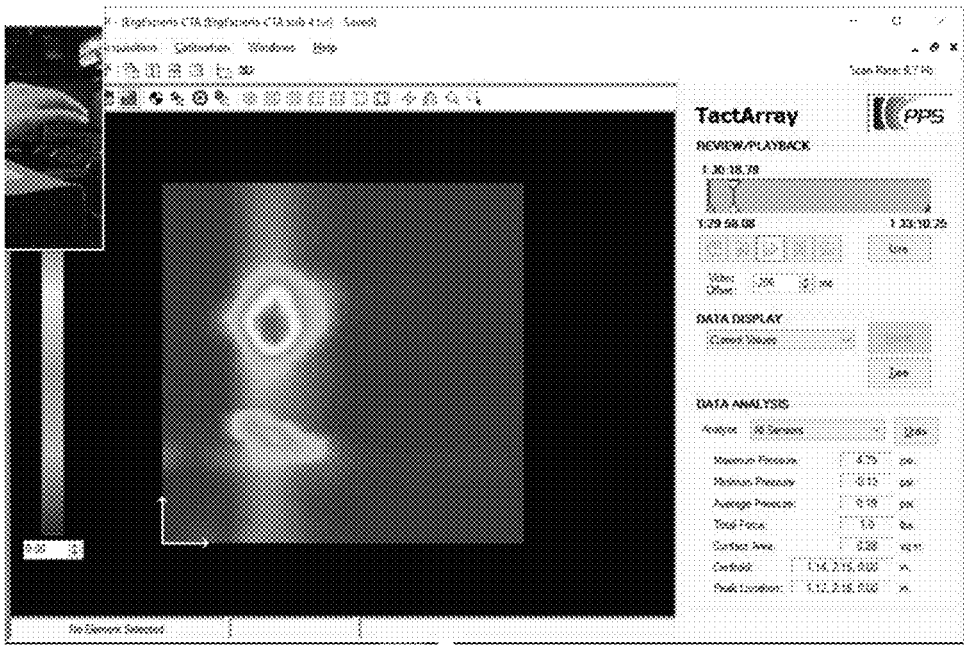
FIG. 15 is the diagram of the test results of the advantages of the present invention regarding less pressure along the carpal tunnel regions.
Figure 15:
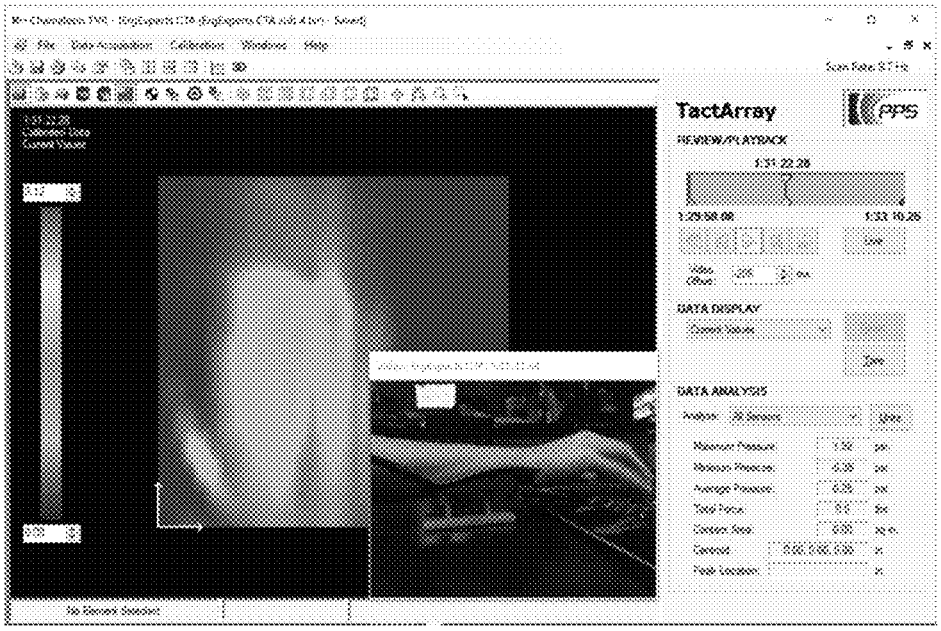

Referring to FIGS. 13 and 14, in an alternative embodiment, a cantilevered design allows for selectively choosing between a range of adjustment points between the between minimum and maximum angles of incidences 86—and thus selectively choosing the latitudinal support angle—through rotating an adjusting knob 94 engaging the proximal end 54, while the distal end 52 provides a pivot point 92.

It should be understood, of course, that the foregoing relates to exemplary embodiments of the invention and that modifications may be made without departing from the spirit and scope of the present invention.

What is claimed is:

1. A wrist and forearm support device for supporting a wrist and forearm during the use of computer-related input devices resting on a supporting surface, comprising:

a body extending from a base end to a wing end;

two wing support spaced apart by a predetermined void along the wing end;

each wing support extending from a distal end to a narrower proximal end so as to define a supine triangle shape, wherein the two wing supports share a latitudinal support angle relative to the supporting surface; and a base having a slanted surface rotatably connected to the base end so that the latitudinal support angle is adjustable by rotating the base relative to the body.

2. The wrist and forearm support of claim 1, wherein the predetermined void is dimensioned to accommodate a carpal tunnel region of a human user's forearm so as not to apply pressure thereto.

3. The wrist and forearm support of claim 2, wherein the predetermined void ranges between one-half inch and one and a quarter inches.

4. The wrist and forearm support of claim 1, wherein a periphery of each wing support provides a waterfall edge.

5. The wrist and forearm support of claim 4, wherein each waterfall edge is defined by a radius of curvature of approximately a quarter inch.

6. The wrist and forearm support of claim 1, wherein the latitudinal support angle is adjustable between a minimum and a maximum angle upon rotating the base relative to the body 180 degrees.

7. The wrist and forearm support of claim 1, further comprising a bottom surface disposed along the base for engaging the supporting surface, wherein the bottom surface provides a low friction element.

8. The wrist and forearm support of claim 1, wherein the latitudinal support angle ranges between seven and fourteen degrees.

9. The wrist and forearm support of claim 1, wherein each wing support is oriented at opposing longitudinal support angles relative to the supporting surface, each longitudinal support angle orthogonal relative to the latitudinal support angle.

10. A wrist and forearm support device for supporting a wrist and forearm during the use of computer-related input devices resting on a supporting surface, comprising:

a body extending from a base end to a wing end;

two wing supports spaced apart by a predetermined void along the wing end, wherein the predetermined void is dimensioned to accommodate a carpal tunnel region of a human user's forearm so as not to apply pressure thereto, and wherein a periphery of each wing support provides a waterfall edge;

each wing support extending from a distal end to a narrower proximal end so as to define a supine triangle shape, wherein each wing support is oriented at an opposing longitudinal and a shared latitudinal support angle, both support angles are relative to the supporting surface and orthogonal to each other, wherein the latitudinal support angle ranges between seven and fourteen degrees, and wherein the longitudinal support angle ranges between five and twenty degrees;

a base having a bottom surface and an opposing slanted surface, wherein the bottom surface provides a low friction element; and the slanted surface rotatably connected to the base end, which is an orthogonal surface relative to the slanted surface, so that the latitudinal support angle is adjustable between a minimum and a maximum angle upon rotating the base relative to the body 180 degrees.

11. The wrist and forearm support of claim 10, wherein the predetermined void ranges between one-half inch and one and a quarter inches.

12. The wrist and forearm support of claim 11, wherein each waterfall edge is defined by a radius of curvature of approximately a quarter inch.

13. The wrist and forearm support of claim 9, wherein the longitudinal support angles range between five and twenty degrees.

14. The wrist and forearm support of claim 1, wherein the latitudinal support angles range is defined by first and second elevations relative the supporting surface, wherein the first distance is defined by a distance the distal end is elevated relative to the supporting surface, and wherein the second distance is defined by a distance that the proximal end is elevated relative to the supporting surface.

15. The wrist and forearm support of claim 1, wherein the base end is orthogonal relative to the rotatably connected slanted surface so that the latitudinal support angle is adjustable by rotating the base relative to the body.

* * * * *